United States Patent [19]

Baert et al.

[11] 4,056,024

[45] Nov. 1, 1977

[54] WEB ADVANCEMENT AND CUTTING MECHANISM AND METHOD

[75] Inventors: Victor R. Baert, Anoka; Ronald B. Harvey, Minneapolis, both of Minn.

[73] Assignee: Pako Corporation, Minneapolis, Minn.

[21] Appl. No.: 627,526

[22] Filed: Oct. 31, 1975

[51] Int. Cl.[2] ..... B26D 5/32; B26D 5/34

[52] U.S. Cl. ..... 83/210; 83/62; 83/371

[58] Field of Search ..... 83/210, 62, 364, 365, 83/369, 371

[56] References Cited

U.S. PATENT DOCUMENTS

| | | | |
|---|---|---|---|
| 3,763,728 | 10/1973 | Blackman | 83/210 |
| 3,793,915 | 2/1974 | Hujer | 83/210 X |
| 3,945,279 | 3/1976 | Boehme et al. | 83/364 X |

*Primary Examiner*—Willie G. Abercrombie
*Attorney, Agent, or Firm*—John W. Adams

[57] ABSTRACT

A web advancement and cutting method and mechanism are provided for a web which is divided into unique segments or frames each incorporating a sensing indicium and in which a plurality of frames is advanced through a cutting mechanism and cut from the web for each cycle of operation. In each cycle of operation, a digital stepper motor drive and counter combination advances the web a predetermined number of counts, generally equivalent to moving all but one of the said plurality of frames to be advanced beyond the cutting plane of a cutting mechanism, and then further advancing without stopping the web until an optical sensor senses the indicium on the last frame to be advanced through the cutting mechanism. The stepper motor is stopped and said plurality of frames is then cut from the web. Means are also provided to reduce the power consumption of the stepper motor while the cutting mechanism is actuated. This invention is described in connection with a commercial processing film cutter which cuts a customer's individual rolls of film into strips of several frames for packaging after processing. The cutting mechanism may be adjusted for different types of film and customer requirements by adjustment of the digital counters associated with the stepper motor advancement mechanism.

12 Claims, 3 Drawing Figures

WEB ADVANCEMENT AND CUTTING MECHANISM AND METHOD

BACKGROUND OF INVENTION

This invention relates to a web advancement and cutting mechanism where several individual segments or frames of the web are advanced at each stage of the process. The web at each cycle of operation must be advanced and stopped in accurate relationship between the frames thereof and the cutting mechanism. More particularly, this invention relates to a film advancement system for a film cutter of the type used in a commercial processing laboratory for cutting a customer's film into strips of several individual frames for packaging after printing.

In the commercial film processing business very high rates of processing must be achieved and maintained in order to operate profitably. Likewise quality of processing and care for the customers' film must be maintained at extremely high levels. This applies especially in the pre-packaging process of cutting customers' rolls of film into strips which will fit into the envelopes in which the individual customers will receive their orders. In commercial film processing, perhaps as many as five hundred to a thousand rolls of twelve, twenty and thirty-six exposure film are initially spliced together for processing and printing purposes. Thus for a time during processing, individual rolls of film lose their identity as part of a single large roll. Then after the prints are made, the individual customer's film must be separated from the large roll of film and cut into strips of several individual frames so that the strips can be placed flat in a delivery envelope together with the prints.

This step of cutting the film at splices to separate customer orders and cutting the orders into strips for packaging must be done accurately between picture frames so that no picture is damaged. Typically, this process may be done at up to 20,000 frames per hour in a large processing facility. An earlier, related device is shown in U.S. Pat. No. 3,656,673 assigned to the same assignee as is the present invention.

SUMMARY OF THE INVENTION

The present invention is a web advancing and cutting mechanism for repeatedly advancing a plurality of frames of a web to a cutting position, stopping and cutting said plurality of frames from the web and then advancing the web for the next cutting operation. A fundamental requirement of the advancement operation is that the film be brought quickly to operating speed, advanced and then slowed to a precisely positioned stopping point so that the cut is made between frames.

The film drive consists of a digital stepper motor acting through a friction drive to move the film through the cutter. The friction drive minimizes the chance of film damage, since the notches in the film edge are not engaged. Said notches are, in this embodiment, sensing indicia to position the film correctly in relation to the cutting mechanism. The digital stepper motor is driven by a motor driver unit which in turn is controlled by other elements of the processing system. The motor driver comprises a variable frequency oscillator and an amplifier connected to drive the stepper motor. As a cycle of operation is initiated, the stepper motor is started at a rate of, for example, 500 Hz. and brought to operating speed of, for example, 2,000 Hz.

The film is advanced a distance sufficient so that the notch associated with the next to last frame to be advanced has passed over a photoelectric notch sensor. This is done by advancing the stepper motor a predetermined number of steps of operation to ensure that the desired number of frames have been advanced. This leaves only the last frame which is to trigger the stop action in range of the notch sensor.

At this time, the notch sensor is activated to control the stop sequence for the stepper motor. When the notch is sensed by the photoelectric device, the variable frequency oscillator controlling the stepper motor drops rapidly and continuously in frequency, so that the film is stopped in a gradual and not abrupt or jerky fashion.

One unique feature of the invention is that significant savings are realized in the power supply and power requirements areas by reducing the power to the stepper motor in the stopped position while the cutter knife operates. The stepper motor is used as a brake to hold the film in position when the stepper motor is stopped. This is accomplished by continuing to energize the last-energized winding of the motor, which magnetically forces the motor to maintain its last-moved position. However, with the power on and the motor stopped, the motor will consume more power at the same voltage than when being stepped. The electric solenoid powering the knife for film cutting takes a burst of power during the time the motor is stopped, and thus if the power supply were built to handle maximum current surges, the power supply would be much larger than required by the duty cycle of the stepper motor. To meet this problem, the voltage to the stepper motor is significantly reduced when the stepper motor is stopped and while the cutter knife solenoid operates thereby minimizing peak power consumption.

The present invention as described is designed for multiple film sizes by use of multiple photoelectric sensors, switchably interchangeable.

Figure 1:
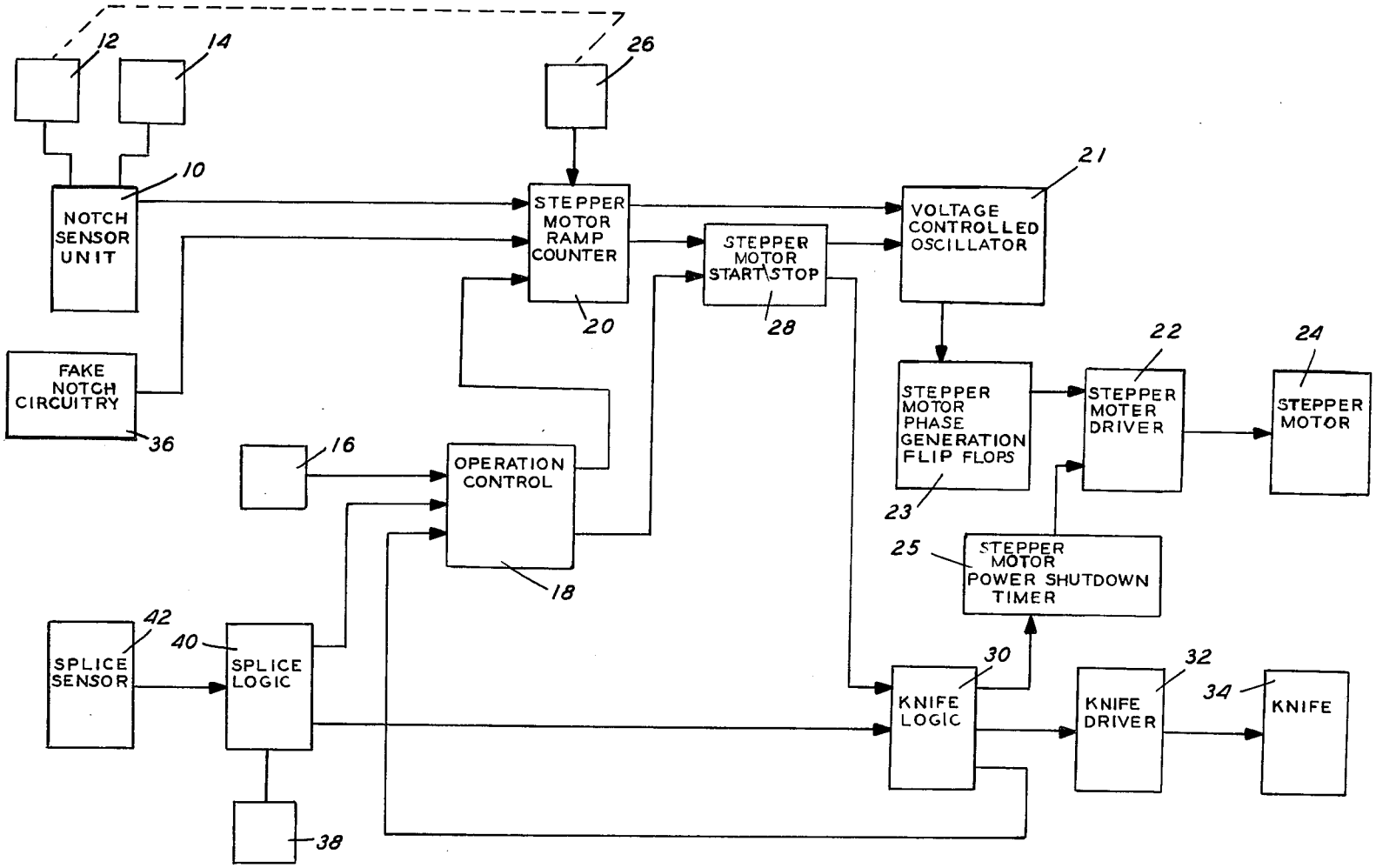
FIG. 1 is a block diagram of the apparatus according to the present invention.

Referring now to FIG. 1, the film processor according to this embodiment of the invention has five optical notch sensors shown as notch sensor unit 10. A plurality of sensors is needed to sense the different sizes of film (e.g. 110, 126 and 135 sizes) and to compensate for the different orientation of the notches depending on whether the last frame of a roll is fed through the first or the first frame is fed through first. The sensors are for actuating the cutter mechanism in the 126 first frame first, 126 last frame first, 110 first frame first, 110 last frame first, and 135 modes of operation are manually determined by the operator by use of the "110, 126, 135" switch 12 and the first frame first, last frame first switch 14, associated with the notch sensor unit 10. There is no material electrical difference between the modes of operation other than the mechanical location of the optical sensors with respect to the film passing through the unit and the use of separate frame counters 20 for each size of film.

A start switch 16, associated with the operation control unit 18, is pushed to initiate a cycle of film advancement. This causes a frame counter 20 to be activated and start film movement. The frame counter shuts off the signals from the notch sensor unit 10 when 110 and 126 size film is used so that notch sensor signals don't trigger the film stop cycle. A motor fast - slow flip-flop associated with counter 20 determines whether the stepper motor 24 operates at the running speed or the slower speed for starting and stopping. The motor 24 is enabled by stepper motor start/stop flip-flop 28 and is gradually brought to speed to avoid a film jerk which would tear the film. When a predetermined number of steps of the motor have been counted by counter 20, the notch sensor unit 10 is activated. The first film notch, after the frame counter 20 activates the notch sensor unit 10, triggers the motor fast - slow filp-flop which causes the stepper motor driver 22 to gradually lower the speed of stepper motor 24. A ramp down counter in counter 20 is initiated by the sensing of the last said film notch and counts the number of steps the motor 24 advances during deceleration. When the ramp down counter reaches a predetermined count, which varies according to film size and is set by the ramp down switches 26, the stop side of a stepper motor start/stop flip-flop 28 is triggered. This in turn triggers a knife timer in a knife logic unit 30. The knife timer through knife logic unit 30 determines when and for how long the knife is energized by knife driver 32.

The stepper motor ramp counter 20 and the motor start-stop flip-flop 28 are connected with a voltage controlled oscillator 21 which determines the drive frequency of the stepper motor 24, and hence the speed of film movement. The oscillator 21 receives a variable voltage from a plurality of conventional resistor-capacitor relaxation circuits associated therewith. Flip-flops in counter 20 and start/stop unit 28 switch the relaxation circuits to cause a gradual change in frequency so that the film is moved without abrupt speed changes. The voltage controlled oscillator 21 drives a conventional arrangement of phase generation flip-flops 23 which develop the actual signals to drive the stepper motor 24.

The stepper motor driver 22 consists of conventional power transistors in an arrangement to drive the stepper motor 24 using signals supplied by the phase generation flip-flop 23. In addition, driver 22 has power transistors controlling the flow of power to said motor drive power transistors. These transistors are responsive to an input to driver 22 from motor power reducing means such as motor power shut-down timer 25 which is connected with knife logic unit 30. After notch sensor unit 10 senses the notch associated with said last frame, but before the knife driver 32 is actuated, knife logic unit 30 signals the shut-down timer 25 to lower the power level delivered to stepper motor 24. This signal may be in the form of a pulse delivered to a flip-flop which activates a relaxation timer. The timer causes the stepper motor 24 to receive a low power level until after the knife has operated by causing said power transistors to saturate and thereby reduce the voltage delivered to said motor 24. This reduces the peak power requirement of the unit since neither the knife 34 nor stepper motor 24 will receive full power at the same time. Thus power supply requirements may be reduced.

When the knife logic unit 30 has cycled an operation of knife 34 it triggers the restart timer in operation control unit 18, which allows the knife 34 a short time interval to return to position and then resets ramp counter 20 and start/stop unit 28 for another cycle and provides full power for stepper motor 24. The mechanism will continue cycling as above until a splice is detected.

Typically 110 and 126 size film is cut in four frame strips and the notch sensor is activated after the third frame. If the film being cut is "off-pitch" at a film splice there is no hole in the film for the notch sensor on the last frame of a strip of film. In this case the notch must be faked. A fake counter 36 counts the steps of a stepper motor 24 and is reset on every sensed notch associated with a film frame. The counter is set to allow a slightly longer feed than one frame length for the last frame in a strip. If no notch is sensed in that distance, one is faked, and the mechanism then operates as if a notch had actually been sensed. Again there is a separate "fake" counter for 110 and 126. "On pitch" film has a hole by each film splice and the faking circuitry is not used.

135 size (35mm) film presents unique problems and therefore requires circuitry different from that used for 110 and 126 size film. The frames in 110 and 126 size film are always in fixed relation to each other, while the exposures on 135 size film may be inches apart or overlapped, due to the film advancement mechanism of 135 type camera. The sensing notches for 110 and 126 film are incorporated into the film as it is manufactured, while the notches are cut in 135 film after it is developed.

Therefore, the counter 20 associated with 135 size film does not disable the notch sensor unit 10 but rather enables unit 10 to sense every notch passing it. Said sensor 20 will, when enabled by operation control unit 18, advance the stepper motor 24 a preset number of steps. If only three complete exposures are sensed within the preset number of steps (in this embodiment equivalent to a length of 6½ inches), counter 20 will cause stepper motor 24 to stop and knife 34 to cut the film directly behind the last sensed exposed frame. This ensures that no strip of 135 film will be too long to be inserted into conventional packages to be returned to the customer.

If sensor unit 10 senses two notches before counter 20 reaches a second preset number of steps which corresponds to a distance slightly longer than the length of a 135 exposure, this indicates that two exposures are overlapped, and the counter 20 may either trip the start/stop flip-flop 28 and stop the mechanism or allow the film to continue, depending upon the selection of the operator.

If less than three complete exposures are sensed within a 6½ inch strip of the film, counter 20 will cause motor 24 to stop and knife 34 to cut a 6½ inch strip from the film. It is, of course, apparent that the two aforesaid preset numbers may be varied to accommodate different varieties of 135 frame size and different notching systems without departing from the teaching of this mechanism.

The operator has the option to choose if he wants the splice to be part of the last piece of film in that order, or part of the first piece of film in the next order. This is done with the cut after splice - cut before splice switch 38 associated with the splice logic unit 40 which receives splice information from splice sensor 42. The splice can also be cut out by cutting on both sides of it, if so desired.

The operation of cut before - cut after splice is as follows: A splice is sensed by the splice sensor 42 which sets a splice latch in logic unit 40. Said sensor 42 is a photosensitive device which detects the greater opacity of a splice as compared with regular film. At the start of stepper motor 24 deceleration on a signal from the motor start/stop flip-flop 28, the splice latch information is transferred to a cut before splice flip-flop in logic unit 40. If switch 38 is in the cut after splice position, at this time the splice no cut flip-flop in logic unit 40 will be set. When the splice no cut flip-flop is set it overrides the knife logic unit 30 command to cut the film after the splice is sensed and prevents start/stop flip-flop 28 from triggering and stopping the motor 24. Then, on the next notch that is sensed, which is first notch of next order, the splice latch information will be transferred from the cut before splice flip-flop to the cut after splice flip-flop in logic unit 40. This initiates the film stopping and cutting cycle as discussed above. If switch 38 is in the cut before splice position, the splice will be cut at the last frame of the strip, the film will then be advanced until the notch of the first frame registers with sensor unit 10, and the advancement and cutting cycle will then be repeated.

When the cut before splice - cut after splice switch 38 is in the position for cutting out the splice, the splice no cut flip-flop is never triggered. Thus the cutter cuts on both sides of the splice so that splice is cut out as a separate piece. The operator has the option of sending this separate piece of film as the last piece of the order just cut or holding it to be the first piece of the next order.

Figure 2:
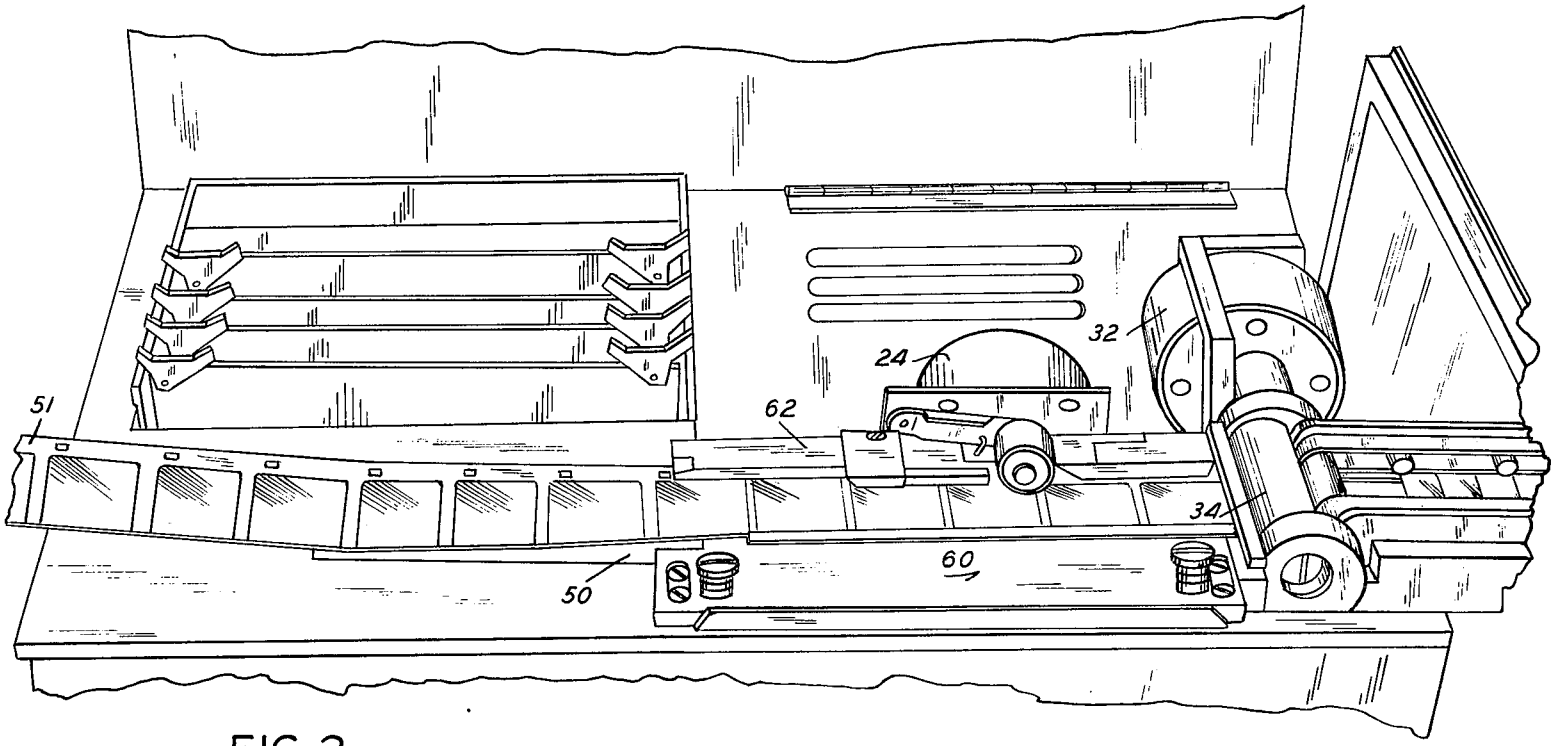
FIG. 2 is a mechanical perspective view of the apparatus according to the present invention.
Figure 3:
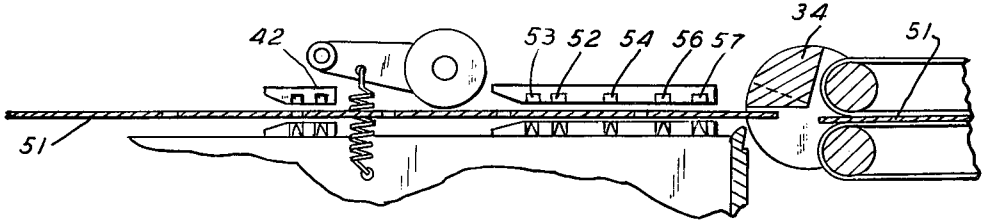
FIG. 3 is a fragmentary longitudinal sectional view of the apparatus shown in FIG. 2.

Referring now to FIG. 2, a unit according to the present invention is shown having a film bed 50 through which film 51 travels to the knife 34 while friction driven by stepper motor 24. The notch sensor photocells 52, 53, 54, 56 and 57 comprise notch sensor 10 and are best shown in FIG. 3. Splice sensor 42 is located to detect a splice by detecting the greater opacity of the material from which a splice is made as compared to the film material.

An adjustable film guide 60 is provided to accommodate the different film widths by holding the notched side of film 51 against fixed film guide 62 in proper relation to the optical sensors.

It will be observed that an effective method for accurately cutting film into strips has been defined herein which comprises the steps of initiating a film advancement cycle which includes advancing the film a predetermined distance by counting the number of steps of the digital stepper motor which drives the film activating the notch sensor in response to the counting of a predetermined number of steps, thereafter advancing the film a further distance without stopping after said sensor has been activated, stopping the film when said sensor senses the indicia of the last frame to be advanced, and cutting off the desired length of film while said film is stopped. In addition to the method defined above, we provide a "fake" notch sensor mechanism which generates a stop signal after the film has been advanced a predetermined number of steps following activation of the notch sensor which stop signal then stops the film in response to the generated signal.

It will, of course, be understood that various changes may be made in the form, details, arrangements and proportions of the parts without departing from the scope of this invention as set forth in the appended claims.

What is claimed is:

1. A film advancement mechanism for film in a film processor comprising:

initiate means connected to the film processor for initiating a cycle of film advancement by the mechanism, digital stepper motor means for advancing film in the processor, drive means for said stepper motor, responsive to said initiate means, for gradually increasing the drive frequency of said stepper motor at the beginning of a cycle of film advancement, driving said stepper motor through a cycle of film advancement and then gradually slowing the drive frequency of said stepper motor at the end of a cycle of film advancement, indicia sensing means for sensing indicia positioned in fixed relation to individual frames of film as the film advances in said mechanism, first counter means, responsive to said initiate means, for counting the steps that said stepper motor advances said film in a cycle of film advancement until a predetermined number is reached and then activating said indicia sensor, second counter means, responsive to said indicia sensor, for controlling said drive means for said stepper motor to cause said motor to be advanced a predetermined number of steps after an indicium is sensed, gradually slowed down and then stopped, wherein said drive means includes voltage controlled oscillator means for producing a variable frequency signal in response to signals from said first and second counter means and said initiate means, and stepper motor drive means for controlling said digital stepper motor means in response to the variable frequency signal, and fake indicia counter means to count steps of said stepper motor after said indicia sensor has been activated for causing said stepper motor to be stopped if an indicium has not been sensed after a predetermined number of advancement steps have occurred.

2. The mechanism of claim 1 and further comprising a film cutting knife, means for driving said knife, means responsive to said second counter means for causing said knife driving means to actuate said knife when film movement has stopped, and means for initiating a cycle of film advancement after said knife has operated.

3. Mechanism of claim 2 and further comprising a single power source connected to both the stepper motor driving means and the knife driving means power reducing means connected with said stepper motor driving means and responsive to said knife actuating means for reducing the power delivered to the stepper motor during the actuation of said knife while maintaining the delivery of sufficient power to the stepper motor to provide a brake for said film during actuation of said knife, so that the total power required to be provided to the stepper motor and the knife during the knife actuation will be substantially less than the sum total of the power normally required for driving both knife and the motor simultaneously.

4. The mechanism of claim 1 and said indicia comprising notches in the film positioned in fixed relation to individual frames contained thereon.

5. A combined film advancement and cutting mechanism for photographic film, to cut said film into strips having a preselected number of exposed frames thereon, comprising:

an adjustable film guide means defining a path of film travel through said mechanism and adjustable for transportation of film of predetermined different widths through said mechansim, means for supplying a continuous strip of film to said film guide means, said film having sensing indicia thereon in fixed relative position to exposed film frames thereon, a plurality of sensors positioned in fixed relation to said film path for sensing said indicia on film strips having different frame lengths and orientations, selective switch means associated with said sensors to control the selection of a predetermined sensor corresponding to the film size to be processed, the state of said selective switch means also determining the values of first and second predetermined numbers of steps of film advance, a stepper motor drive mechanism for driving said film through said film path, control means connected to said switch means and said drive mechanism for determining the number of steps of film advance and the stopping position for each film strip to be cut by said mechanism, said means being responsive to information detected by a selected sensor to choose a preselected stopping position for the film size being processed, said control means including first counter means for counting the number of steps of film advance and activating said selected sensor when the film has been advanced by the first predetermined number of steps, and further including second counter means for counting the number of steps of film advance after said selected sensor senses an indicium and including means for halting said stepper motor drive mechanism when the film has been advanced by the second predetermined number of steps, film cutter actuating means connected to said control means responsive to a predetermined number of steps of film advance and the stopping of said stepper motor drive mechanism, and a film cutter connected to said actuating means and mounted in said film path for cutting said film into strips in response to control signals developed by said actuating means.

6. The mechanism of claim 1 wherein the drive means further comprises:

stepper motor stop/start means connected to said initiate means, said second counter means, and said voltage controlled oscillator means for enabling said voltage controlled oscillator means in response to a signal from said initiate means and for disabling said voltage controlled oscillator means when said second counter means reaches a predetermined count.

7. The mechanism of claim 6 and further comprising:

motor fast/slow means for causing said voltage controlled oscillator means to gradually reduce the frequency of the variable frequency signal when an indicium is sensed.

8. The mechanism of claim 7 wherein the motor fast/slow means further causes said voltage controlled oscillator means to gradually increase the frequency of the variable frequency signal at the beginning of a cycle of film advancement.

9. A film advancement and cutting mechanism comprising:

motor means for advancing the film, motor drive means for driving the motor means, control means for determining a stopping position of the film and causing the drive means to stop the motor means, film cutting knife means for cutting the film, knife drive means for driving the film cutting knife means, knife actuating means responsive to the control means for causing the knife drive means to actuate the film cutting knife means when the motor means and film movement has stopped, power source means connected to both the motor drive means and the knife drive means, and power reducing means connected with the motor drive means and responsive to the knife actuating means for reducing the power delivered to the motor means while maintaining the delivery of sufficient power to the motor means to provide a brake for the film during actuation of the knife means.

10. A film advancement mechanism for film in a film processor comprising:

initiate means connected to the film processor for initiating a cycle of film advancement by the mechanism, digital stepper motor means for advancing film in the processor, drive means for said stepper motor, responsive to said initiate means, for gradually increasing the drive frequency of said stepper motor at the beginning of a cycle of film advancement driving said stepper motor through a cycle of film advancement and then gradually slowing the drive frequency of said stepper motor at the end of a cycle of film advancement, indicia sensing means for sensing indicia positioned in fixed relation to individual frames of film as the film advances in said mechanism, first counter means, responsive to said initiate means, for counting the steps that said stepper motor advances said film in a cycle of film advancement until a predetermined number is reached and then activating said indicia sensor, second counter means, responsive to said indicia sensor, for controlling said drive means for said stepper motor to cause said motor to be advanced a predetermined number of steps after an indicium is sensed, gradually slowed down and then stopped, a film cutting knife, means for driving said knife, means responsive to said second counter means for causing said knife driving means to actuate said knife when film movement has stopped, means for initiating a cycle of film advancement after said knife has operated, a single power source connected to both the stepper motor driving means and the knife driving means, power reducing means connected with said stepper motor driving means and responsive to said knife actuating means for reducing the power delivered to the stepper motor during the actuation of said knife while maintaining the delivery of sufficient power to the stepper motor to provide a brake for said film during actuation of said knife, so that the total power required to be provided to the stepper motor and the knife during the knife actuation will be substantially less than the sum total of the power normally required for driving both knife and the motor simultaneously.

11. A film advancement mechanism for film in a film processor comprising:

initiate means connected to the film processor for initiating a cycle of film advancement by the mechanism, digital stepper motor means for advancing film in the processor, drive means for said stepper motor, responsive to said initiate means, for gradually increasing the drive frequency of said stepper motor at the beginning of a cycle of film advancement, driving said stepper motor through a cycle of film advancement and then gradually slowing the drive frequency of said stepper motor at the end of a cycle of film advancement, indicia sensing means for sensing indicia positioned in fixed relation to individual frames of film as the film advances in said mechanism, first counter means, responsive to said initiate means, for counting the steps that said stepper motor advances said film in a cycle of film advancement until a predetermined number is reached and then activating said indicia sensor, second counter means, responsive to said indicia sensor, for controlling said drive means for said stepper motor to cause said motor to be advanced a predetermined number of steps after an indicium is sensed, gradually slowed down and then stopped, fake indicia counter means to count steps of said stepper motor after said indicia sensor has been activated for causing said stepper motor to be stopped if an indicium has not been sensed after a predetermined number of advancement steps have occurred.

12. The mechanism of claim 11 and said indicia comprising:

notches in the film positioned in fixed relation to individual frames contained thereon.

* * * * *